United States Patent [19]

Hart et al.

[11] Patent Number: 4,501,215

[45] Date of Patent: Feb. 26, 1985

[54] HIGH HEEL ANGLE MAST STAY RELEASE STRUCTURE

[76] Inventors: Daniel W. Hart; Helen F. Hart, both of P.O. Box 432, Lanark, Fla. 32323

[21] Appl. No.: 519,232

[22] Filed: Aug. 2, 1983

[51] Int. Cl.[3] ..... B63B 35/00

[52] U.S. Cl. ..... 114/39; 114/91

[58] Field of Search ..... 114/39, 89–101, 114/143

[56] References Cited

U.S. PATENT DOCUMENTS

| | | | |
|---|---|---|---|
| 559,983 | 5/1896 | McLean | 114/91 |
| 720,074 | 2/1903 | Schwanebeck | 114/91 |
| 3,323,480 | 6/1967 | Criou | 114/91 |
| 3,610,190 | 10/1971 | Palmer | 114/91 |
| 3,985,106 | 10/1976 | Ross | 114/91 |
| 4,192,247 | 3/1980 | Riordan | 114/91 |

FOREIGN PATENT DOCUMENTS

| | | | |
|---|---|---|---|
| 663452 | 2/1928 | France | 114/143 |

*Primary Examiner*—Trygve M. Blix
*Assistant Examiner*—Stephen P. Avila
*Attorney, Agent, or Firm*—Harvey B. Jacobson

[57] ABSTRACT

An upright mast is mounted from the lateral center of the hull of a sail boat having opposite sides. The lower end of the mast is pivotally supported from the hull for angular displacement about a horizontal fore and aft extending axis adjacent the lower end of the mast and the upper end portion of the mast includes mast stay guide structure relative to which elongated flexible mast stays are guidingly engaged along their midportion for longitudinal displacement relative to the stay guide structure. One pair of corresponding ends of the stays are anchored relative to the hull opposite sides and the other pair of corresponding ends of the stays depend downwardly along the mast. Latch structure releasably anchors the other ends of the stays against upward movement along the mast and the latch structure includes high heel angle sensing release structure operative to release the other end portions of the stays for upward movement along the mast responsive to the hull experiencing a high heel angle above a predetermined maximum desired heel angle. Further, structure is connected between the hull and the mast, independent of the stays, operative to yieldingly resist angular displacement of the mast relative to the hull from a predetermined center position of the mast.

4 Claims, 6 Drawing Figures

HIGH HEEL ANGLE MAST STAY RELEASE STRUCTURE

BACKGROUND OF THE INVENTION

Many monohull sail boats are subject to being capsized by high winds inasmuch as they do not include sufficient keel weighting to limit excessively high heel angles and to right the hulls subsequent to those hulls experiencing excessive heel angles due to high wind. Accordingly, and particularly when smaller sail boats are being crewed by persons other than adults, considerable danger exists in the event sudden high winds are experienced by a sail boat from abeam. Accordingly, a need exists for structure by which a sail boat may resist heeling to the point of capsizing as a result of high winds when that sail boat is not provided with sufficient keel weighting to prevent capsizing by wind.

Although various forms of mast pivoting structures designed to prevent capsizing of monohull boats heretofore have been provided, most of these previously known structures are relatively complex and are not readily adaptable to existing boat hulls. Examples of previously known forms of pivoted mast structures for preventing capsizing by sudden wind gusts from abeam and which include some of the general structural and operational features of the instant invention are disclosed in U.S. Pat. Nos. 100,151, 720,074, 559,983, 3,323,480, 3,610,190 and 3,985,106.

BRIEF DESCRIPTION OF THE INVENTION

The high heel angle mast stay release structure of the instant invention is used in conjunction with an upright mast pivoted at its lower end form an associated boat hull for angular displacement about a horizontal fore and aft extending axis and yieldingly biased toward a centered upright position. Mast stays extend and converge upwardly from opposite sides of the boat and pass about guide pulleys mounted adjacent the upper terminal end of the mast and then extended downwardly along the mast and are joined by a connecting structure mounted from the mast for guided up-and-down movement therealong and comprising a latch member. A keeper member in the form of a weighted pendulum lever is pivotally mounted from the hull for oscillation relative to the hull about a fore and aft extending axis responsive to heeling movements of the hull and engages the latch member to prevent its upward movement along the mast until such time as a maximum angle of desired heel of the hull is sensed by the keeper member, under which condition the keeper member pivots to a release position and releases the latch member for upward movement along the mast thereby slackening the stays and allowing angular displacement of the mast relative of the hull to leeward and the hull to right itself even in high winds from a beam.

The main object of this invention is to provide a pivoted mast for a sail boat hull anchored in upright position relative to the hull by mast stays which are anchored to the mast by latch structure releasable responsive to the hull experiencing a maximum desired heel angle.

Another object of this invention is to provide a pivoted mast in accordance with the preceding object and wherein structure is provided for yieldingly biasing the mast toward an upright position and which thereby facilitates restoring the mast to an upright position after it has been released to prevent capsizing.

Still another important object of this invention is to provide a pivoted mast construction in accordance with the preceding objects and wherein the latch structure for releasing the mast is carried by a lower portion of the mast and thereby may be readily retrofitted to existing sail boats as well as incorporated in the manufacture of new sail boats.

A final object of this invention to be specifically enumerated herein is to provide a high heel angle mast stay release structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
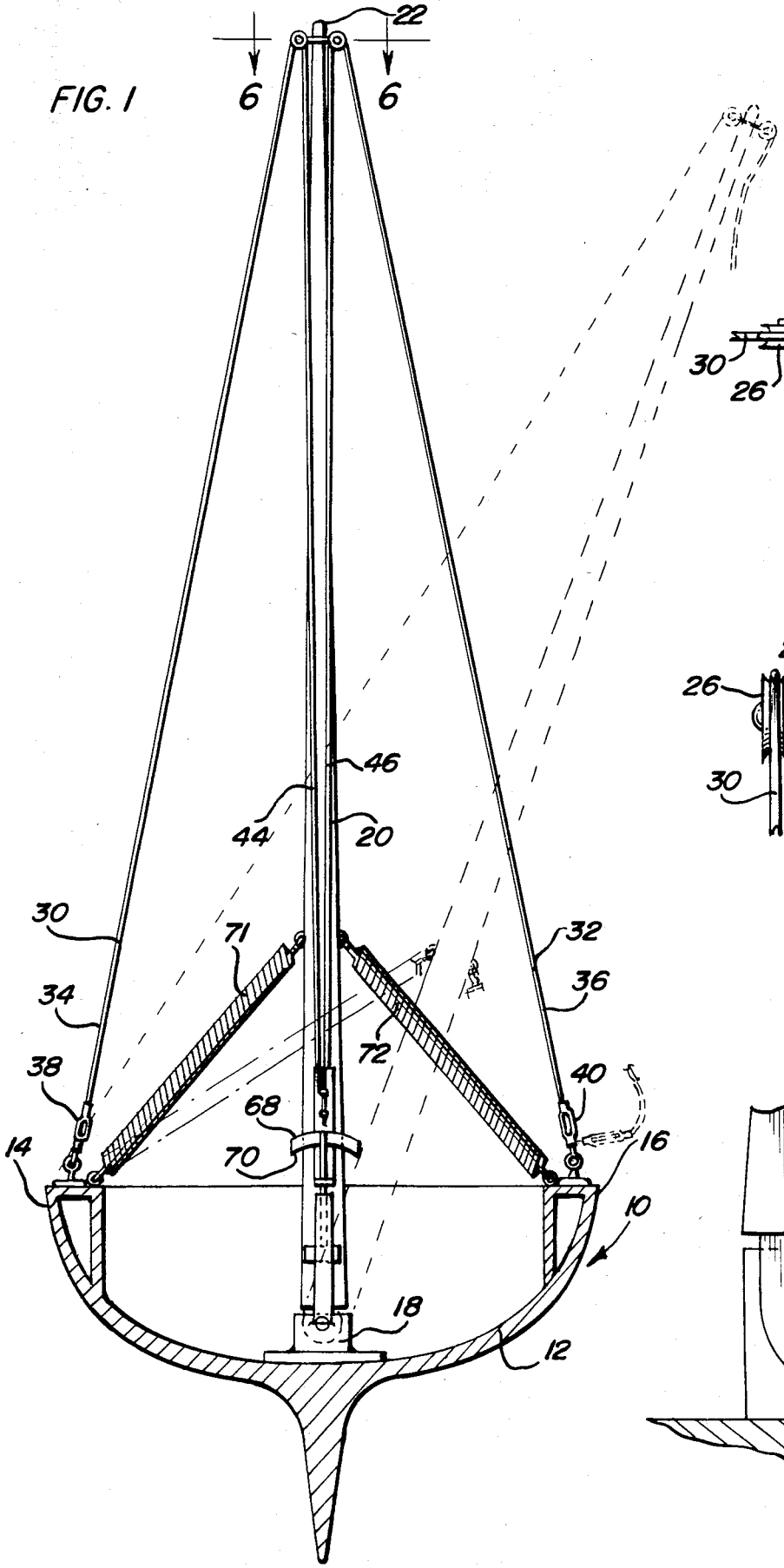
FIG. 1 is a transverse vertical sectional view of a typical form of sail boat hull equipped with a pivotally mounted mast and the mast stay release structure of the instant invention.
Figure 6:
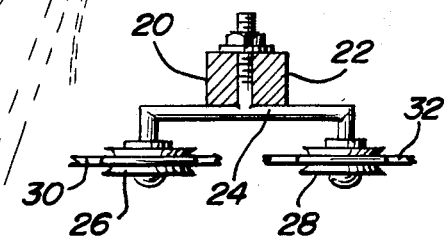
FIG. 6 is an enlarged horizontal sectional view taken substantially upon the plane indicated by the section line 6—6 of FIG. 1.
Figure 2:
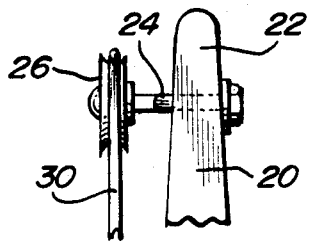
FIG. 2 is an enlarged side elevational view of the upper terminal end portion of the mast.
Figure 3:
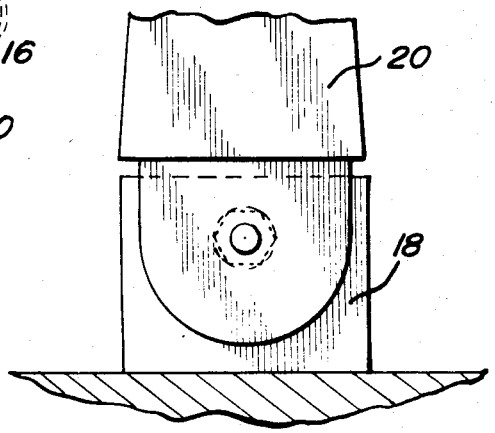
FIG. 3 is an enlarged fragmentary elevational view illustrating the manner in which the lower end of the mast is pivotally anchored to the hull.
Figure 4:
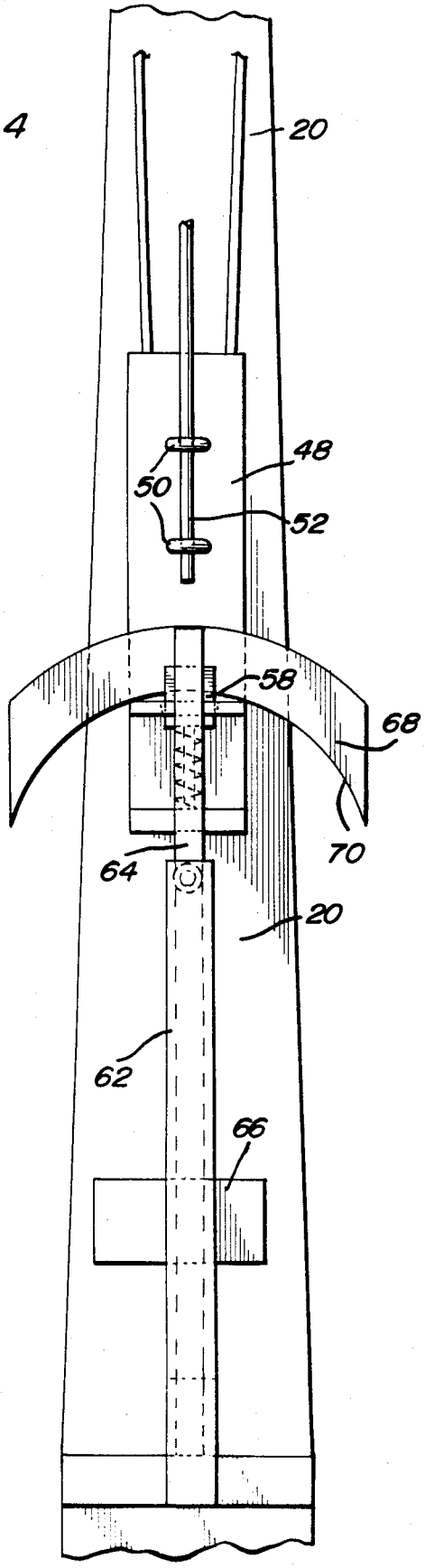
FIG. 4 is an enlarged rear elevational view of the mast stay latch structure.
Figure 5:
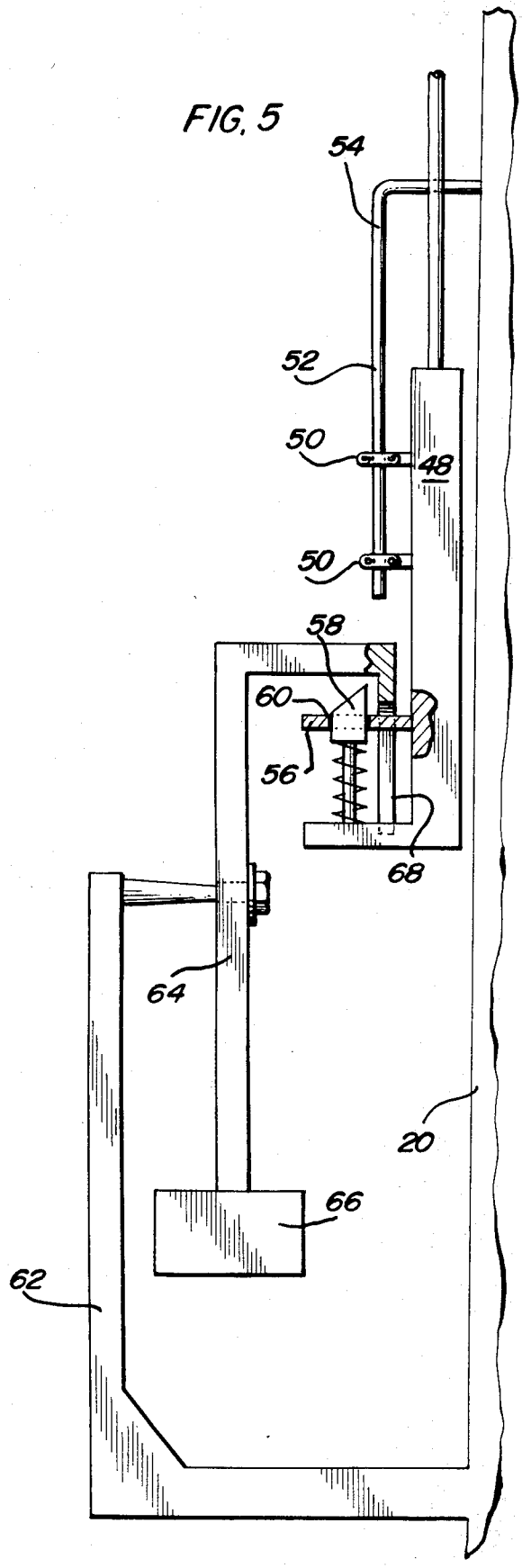
FIG. 5 is a fragmentary side elevational view of the assemblage illustrated in FIG. 4 as seen from the right side thereof.

Referring now more specifically to the drawings, the numeral 10 generally illustrates a sail boat including a hull 12 provided with opposite sides 14 and 16. A lower central interior portion of the hull 12 supports a mount 18 from which the lower end of an upright mast 20 is pivotally supported for angular displacement of the mast 20 relative to the hull about a fore and aft extending horizontal axis.

The upper terminal end portion 22 of the mast 20 includes a guide support 24 supported therefrom and the guide support 24 journals a pair of guide rollers 26 and 28 for rotation about horizontal fore and aft extending axes spaced laterally apart trasversely of the hull 12.

A pair of mast stays 30 and 32 are provided and include a first set of end portions 34 and 36 which are anchored relative to the sides 14 and 16 by adjustable turnbuckles 38 and 40. The longitudinal midportions of the stays 30 and 32 pass over the guide rollers 26 and 28 and the other pair of corresponding end portions 44 and 46 extend downwardly along the mast 20 and are anchored relative to a connecting structure 48 comprising a latch member. The latch member 48 is vertically elongated and the upper portion thereof includes vertically spaced guide eyes 50 through which a depending free end portion 52 of a guide bar 54 is slidingly received. The lower end portion of the latch member 48 includes a horizontally rearwardly projecting latch element 56 and a bevelled spring biased keeper bolt 58 is supported from the lower terminal end of the latch member 48 and is spring biased toward an operative position projecting upwardly through an opening 60 formed in the latch element 56.

The lower end of the mast 20 supports a mount 62 which projects upwardly along the lower terminal end of the mast 20 and has a weighted pendulum-type keeper member 64 oscillatably supported therefrom for angular displacement about a horizontal fore and aft extending axis. The lower end of the keeper member 64 is weighted as at 66 and the upper end thereof includes an arcuate keeper portion 68 which passes over the latch element 56.

The arcuate concave undersurface 70 of the keeper portion 68 opposes the latch element 56 and prevents the latch member 48 from shifting upwardly along the mast 20. In this manner, the mast stays 30 and 32 are retained in a tensioned condition and the mast 20 is held upright relative to the hull 12. However, when the hull 10 is heeled to a maximum desired heel angle of approximately 70°, the pendulum-type keeper member 64 will remain upright and one end of the undersurface 70 will pass out of registry with the latch element 56 and thus allow upward movement of the latch member 48 along the mast 20 and the tension of the mast stays 30 and 32 to be released. Once the tension of the stays 30 and 32 has been released, the mast 20 is free to pivot relative to the hull and the wind incident upon a sail supported from the mast is no longer effected to apply upset forces on the hull 12. Thus, the hull 12 may return to an upright position. After the tension of the stays 30 and 32 has once been released, expansion springs 71 and 72 connected between the sides 14 and 16 and elevated lower portions of the mast 20 facilitate manual return of the mast 20 to an upright position. After the mast 20 has been returned to an upright position, the latch member 48 may be pulled downwardly along the mast 20 in order to tension the stays 30 and 32 and the keeper member 64 may be pivoted from the upright position to allow the arcuate keeper portion 68 to again be swung into position over the latch element 56.

If it is desired, sufficient spacing may be provided between the mast 20 and latch member 48 to allow the latch element 56 to be engaged beneath the arcuate keeper portion 68 merely by horizontal displacement therebeneath past the bevelled keeper bolt 58, in which case the upper end portion of the guide bar 54 must be sufficiently flexive to allow bending of the guide bar 54 to an extent that the latch elevent 56 may be shifted horizontally beneath the arcuate keeper portion 68 to position the latter between the keeper bolt 58 and the main body of the latch member 48.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a sail boat subject to high heel angles and including a hull having opposite sides between which the lower end portion of an upright mast is pivotally mounted for angular displacement about a fore and aft extending axis, the upper end portion of said mast including mast stay guide means relative to which elongated flexible mast stay may be guidingly engaged for longitudinal displacement relative thereto, at least one pair of elongated flexible stays, anchor means anchoring one pair of corresponding end portions of said stays relative to opposite side portions of said hull, the longitudinal midportions of said stays being guidingly engaged with said guide means and the other pair of corresponding end portions of said stays extending downwardly along said mast away from said guide means, full releasing and manually resettable latch means releasably anchoring the other set of end portions of said stays against upward movement along said mast, said latch means including high heel angle sensing release means operative to fully release the other end portion of said stays for upward movement along said mast responsive to said hull experiencing a high heel angle above a predetermined maximum desired heel angle, and angular displacement resisting means operatively connected between said hull and mast, independent of said stays, operative to yieldingly resist angular displacement of said mast relative to said hull from a predetermined center position of said mast.

2. The sail boat of claim 1 wherein said high heel angle sensing release means includes a weighted pendulum-type release lever pivotally supported from said mast for angular displacement about a fore and aft extending axis.

3. The sail boat of claim 1 wherein said angular displacement resisting means includes a spring means connected between said hull and mast yieldingly biasing said mast toward said center position.

4. The sail boat of claim 1 wherein said axis is spaced appreciably below said anchor means.

* * * * *